US009376176B1

(12) United States Patent
Holden

(10) Patent No.: US 9,376,176 B1
(45) Date of Patent: Jun. 28, 2016

(54) STAND UP PADDLEBOARD HAVING IMPROVED ROWING CHARACTERISTICS

(71) Applicant: Geoffrey Peter Stanley Holden, Wilmington, NC (US)

(72) Inventor: Geoffrey Peter Stanley Holden, Wilmington, NC (US)

( * ) Notice: Subject to any disclaimer, the term of this patent is extended or adjusted under 35 U.S.C. 154(b) by 0 days.

(21) Appl. No.: 14/468,230

(22) Filed: Aug. 25, 2014

Related U.S. Application Data

(60) Provisional application No. 61/869,732, filed on Aug. 25, 2013.

(51) Int. Cl.
*B63B 35/79* (2006.01)
*B63H 16/04* (2006.01)
*B63H 16/06* (2006.01)

(52) U.S. Cl.
CPC ..... *B63B 35/79* (2013.01); *B63B 35/7926* (2013.01); *B63H 16/04* (2013.01); *B63H 16/06* (2013.01)

(58) Field of Classification Search
CPC ..... B63H 16/04; B63H 16/06
USPC ..... 440/101, 104; 441/65, 74
See application file for complete search history.

(56) References Cited

U.S. PATENT DOCUMENTS

| | | | | |
|---|---|---|---|---|
| 6,632,111 | B2 * | 10/2003 | Oathout | 440/104 |
| 6,796,863 | B1 * | 9/2004 | Oathout | 440/104 |
| 9,180,948 | B2 * | 11/2015 | Prade | B63H 16/06 |
| 2014/0187108 | A1 * | 7/2014 | Prade | 440/104 |

FOREIGN PATENT DOCUMENTS

DE 102012106672 A1 * 2/2013

* cited by examiner

*Primary Examiner* — Lars A Olson
(74) *Attorney, Agent, or Firm* — NK Patent Law

(57) ABSTRACT

A stand up paddleboard is provided. The paddleboard includes a base portion having an upper facing surface configured for being stood upon by a user and a downward facing generally flat planar surface and a support selectively engageable with the base portion and defining one or more pivot points for pivoting an oar about the pivot point during rowing. The paddleboard has a first configuration in which the support is not engaged with the base portion and second configuration in which the support is engaged with the base portion and extends in a generally upwardly direction from the upper facing surface of the base portion.

11 Claims, 7 Drawing Sheets

A > B
C < D

STAND UP PADDLEBOARD HAVING IMPROVED ROWING CHARACTERISTICS

CROSS-REFERENCE TO RELATED APPLICATIONS

This application claims priority to U.S. Provisional Application No. 61/869,732 filed on Aug. 25, 2013, the entire contents of which are hereby incorporated by reference.

TECHNICAL FIELD

The presently disclosed subject matter is directed towards a stand up paddleboard, and more particularly, towards a stand up paddleboard having improved rowing and paddle stroke characteristics.

BACKGROUND

Standup paddleboarding (SUP) is a sport involving an oversized surfboard in combination with a paddle for propulsion. The user stands on the SUP and moves the board through the water by paddling on both sides as one would paddle a canoe. Because of the high center of gravity and lack of leverage it is difficult to propel the SUP in other than ideal conditions (wind, waves, current, etc). Furthermore, due to the relatively narrow width of the SUP and height of the user, little leverage can be applied with each stroke without increasing instability of the system. Hence, a SUP user has a distinct lack of stability under operation; and additionally when moving from a prone position to a standing position. Because of the high center of gravity a user has to overcome, undue fatigue results as the forces associated with paddling passes from the users body, legs and stationary feet on the paddle board Accordingly, there remains a need for a device that addresses the various disadvantages associated with previous devices.

SUMMARY

According to one or more embodiments, a stand up paddleboard is provided. The paddleboard may include a base portion having an upper facing surface configured for being stood upon by a user and a downward facing generally flat planar surface and a support selectively engageable with the base portion and defining one or more pivot points for pivoting an oar about the pivot point during rowing. The paddleboard has a first configuration in which the support is not engaged with the base portion and second configuration in which the support is engaged with the base portion and extends in a generally upwardly direction from the upper facing surface of the base portion.

According to one or more embodiments, the support is a single support.

According to one or more embodiments, the support is one or more supports.

According to one or more embodiments, the support is adjustable in length to thereby adjust the height of the one or more pivot points.

According to one or more embodiments, the one or more pivot points includes a pivot point that is forward-facing of the support when the support is engaged with the base portion.

According to one or more embodiments, the pivot point that is forward-facing of the support comprises a flexible assembly extending from the support and engaging with the oar at and end spaced-apart from the support.

According to one or more embodiments, the flexible assembly is configured such that the end spaced-apart from the support maintains a predetermined distance from the support but not a predetermined orientation relative to the support.

According to one or more embodiments, the support defines a portion for being grasped by a user seated, standing or prone on the paddleboard.

According to one or more embodiments, the paddleboard includes a skeg extending from the bottom facing surface.

According to one or more embodiments, the support is selectively engageable about a support base.

According to one or more embodiments, the support is integrated into the base or removable and selectively engageable.

According to one or more embodiments, a method for navigating a stand up paddleboard is provided, including positioning an oar into engagement with the pivot point and rowing the oar along a length of the paddleboard.

According to one or more embodiments, a kit is provided. The kit includes a stand up paddle board of the type having a base portion having an upper facing surface configured for being stood upon by a user and a downward facing generally flat planar surface and a support selectively engageable with the base portion and defining one or more pivot points for pivoting an oar about the pivot point during rowing such that there is provided a first configuration in which the support is not engaged with the base portion and second configuration in which the support is engaged with the base portion and extends in a generally upwardly direction from the upper facing surface of the base portion.

According to one or more embodiments, a support that is selectively engageable with a base portion of a stand up paddle board is provided. The support defines one or more pivot points for pivoting an oar about the pivot point during rowing such that there is provided a first configuration in which the support is not engaged with the base portion and second configuration in which the support is engaged with the base portion and extends in a generally upwardly direction from the upper facing surface of the base portion.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

The presently disclosed subject matter now will be described more fully hereinafter with reference to the accompanying drawings, in which some, but not all embodiments are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
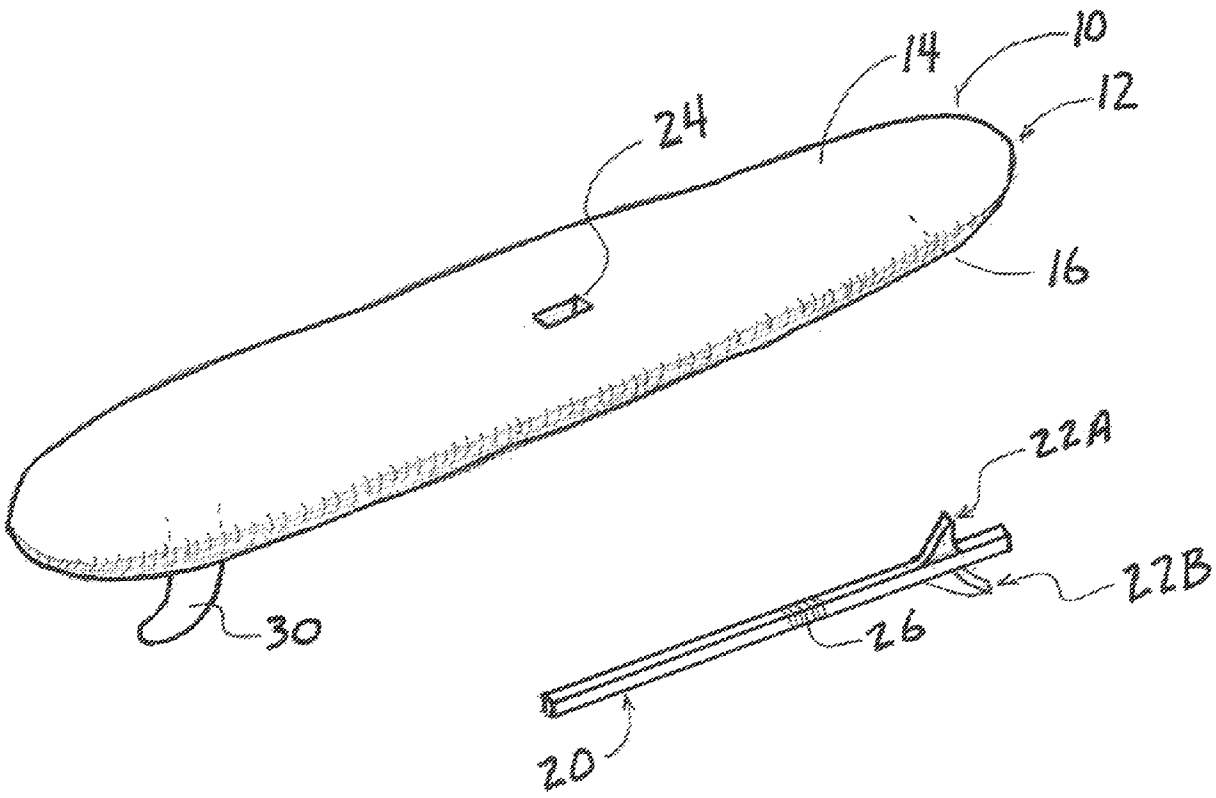
FIG. 1 is a perspective view of a stand up paddleboard having a support that is not engaged and removable therewith according to one or more embodiments disclosed herein.
Figure 2:
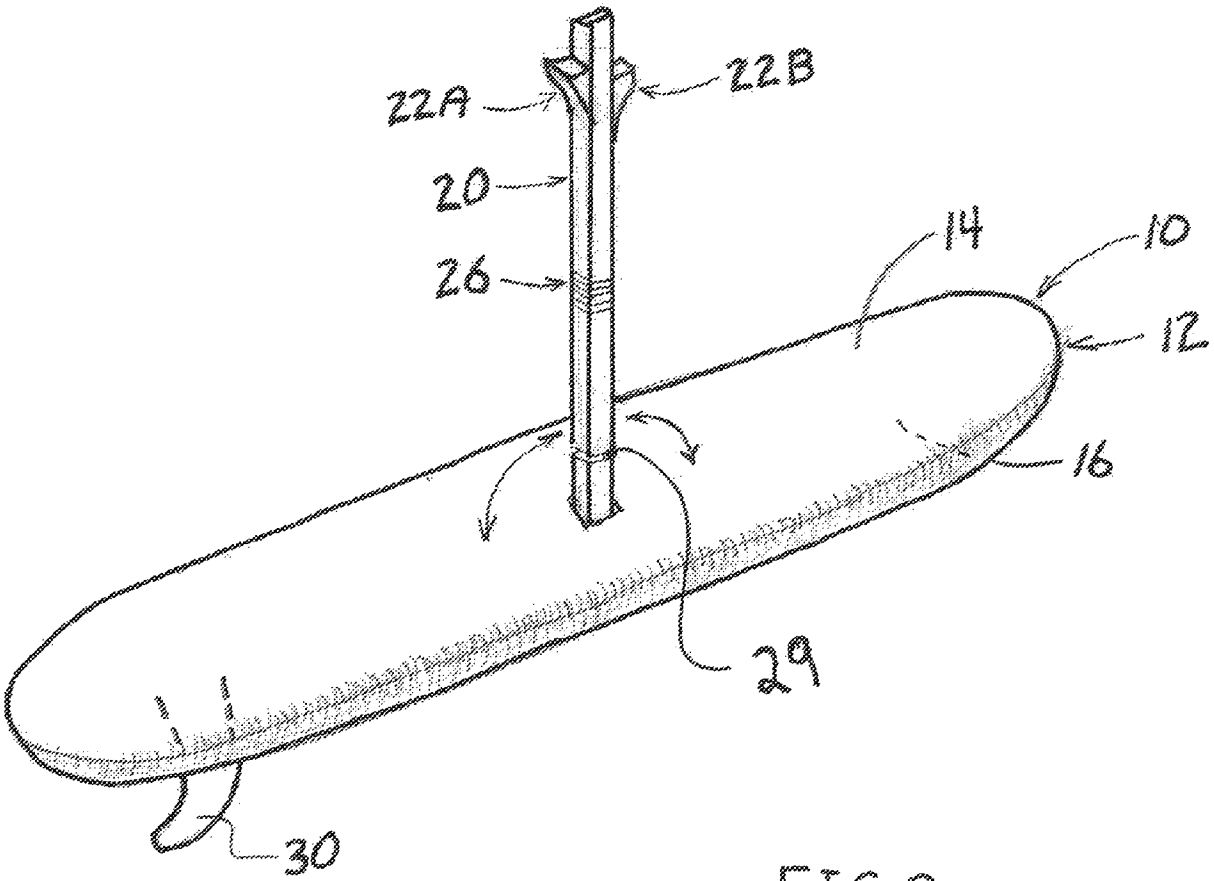
FIG. 2 is a perspective view of a stand up paddleboard having a foldable support engaged integrated therewith according to one or more embodiments disclosed herein.

A stand up paddleboard (SUP) 10 is provided and illustrated throughout the drawings. The SUP 10 is used as a recreational, exercise, or transportation device. According to FIG. 1, the SUP 10 may include a base portion 12 having an upper facing surface 14 configured for being stood upon by a user. The SUP 10 may further include a downwardly facing generally flat planar surface 16. The upper facing surface 14 and generally flat planar surface 16 may define the shape and orientation shown in the drawings or any other appropriately configured shape. The SUP 10 may define a support 20 selectively engageable with the base portion and defining one or more pivot points (22A 22B shown in FIGS. 1 and 2, tether 122 in FIG. 5) for pivoting an oar 28 about the respective pivot point during rowing. The SUP 10 has a first configuration in which the support 20 is not engaged with the base portion 12 (FIG. 1) and a second configuration in which the support 20 is engaged with the base portion 12 (FIG. 2) and extends in a generally upwardly direction from the upper facing surface 14 of the base portion 12. FIG. 1 illustrates the support 20 removed from the SUP 10; likewise the support 20 could be permanently integrated into the base portion 12 and not engaged when folded into an unusable position.

Figure 3:
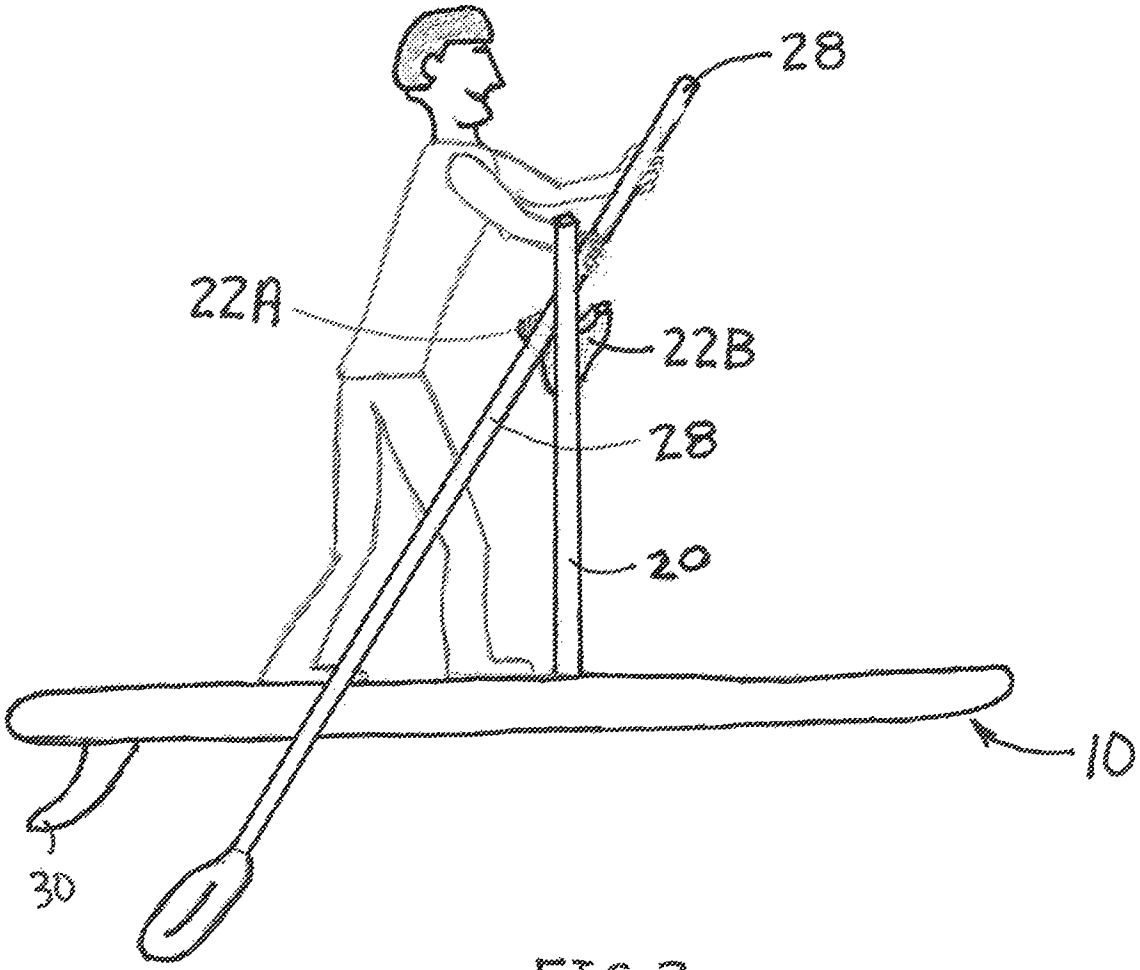
FIG. 3 is a side view of a stand up paddleboard having an oar engaged with a rear-facing pivot of a support according to one or more embodiments disclosed herein.
Figure 4:
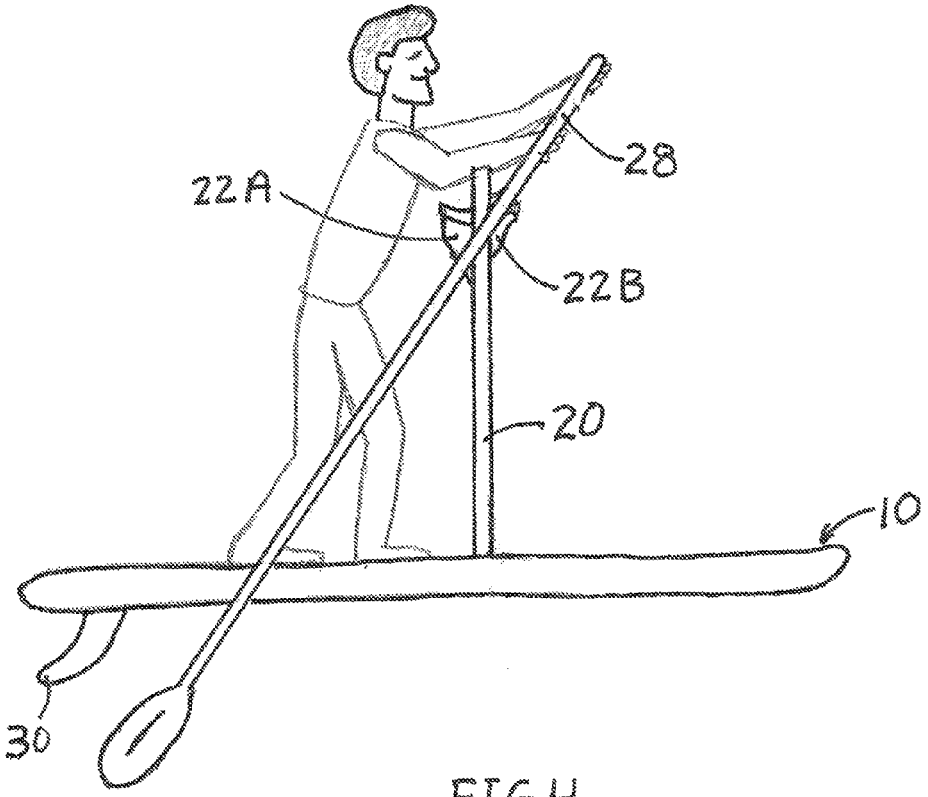
FIG. 4 is a side view of a stand up paddleboard having an oar engaged with a front-facing pivot of a support according to one or more embodiments disclosed herein.

As illustrated, the support 20 is a single support member but may be a plurality of uprights if needed. For example, a tandem configuration incorporated into an SUP built for two could be utilized. Here the support post 20 could be on or offset the center line and around the center of gravity. As also illustrated in FIGS. 3, 4, and 5, the support 20 is shown slightly fore of the midpoint and positioned on the center line of the SUP 10. In one or more embodiments, the support 20 may be offset along the width of the SUP 10 and may be positioned along any length of the base portion 12. Tandem configurations may have support posts on alternating sides of the center line.

In one or more embodiments, the support 20 is adjustable in length to thereby adjust the height of the one or more pivot points. In this manner, the support 20 may be adjusted to fit persons of different heights. The support 20 may be adjustable by any of a variety of configurations, including, telescopic movement, a pin and plurality of openings associated with telescopic assemblies, trimming of the support, or a spring-loaded telescopic assembly.

FIGS. 1 through 4 show that the pivot points may be a rear-facing pivot 22A that extends rearwardly off of the support 20. Pivot point 22A may be an arcuate cantilevered member that is configured for receivably engaging the oar 28. In the orientation where the pivot is rear-facing as illustrated in FIG. 3, the user is able to push the oar against support 20 to work a defined set of muscle groups.

The pivot points may be a front-facing pivot 22B that extends forwardly off of the support 20. Pivot point 22B may be an arcuate cantilevered member that is configured for receivably engaging the oar 28. In the orientation where the pivot is front-facing as illustrated in FIG. 4, the user is able to push and pull the oar 28 against support 20 to work a defined set of muscle groups.

In one or more embodiments, the support 20 may be provided with a single pivot point 22 or member forming a pivot point and the support 20 can be rotated and engaged with recess/support base 24 in either of a desired front-facing arrangement of pivot point 22 or a rear-facing arrangement of pivot point 22. The SUP 10 may include a skeg 30 extending from the bottom facing surface.

In one or more embodiments, the support 20 may define a portion 26 for being grasped by a user seated on the SUP 10. Support 20 may have other advantageous uses associated with upright supports or poles.

In one or more embodiments, the support 20 is removable and engaged by attaching to a permanent mount on the top surface of the panel 12.

The support 20 may include a hinged portion 29 that allows for the support 20 to fold down into either of the fore or aft directions to collapse the support 20 into general elongate alignment with the SUP 10.

As illustrated in FIG. 5, the pivot point may be a flexible assembly 122 extending from the support 20 and engaging with the oar 28 at and end spaced-apart from the support. One end of the flexible assembly 122 may contain a loop of material 124 configured for being slideably engaged with the support 20. Another end of the flexible assembly 122 may contain a loop of material 126 configured for slideably engaging with oar 28. In this manner, the user can engaged loop 126 with the oar 28. The flexible assembly 122 is configured such that the loop 126 spaced-apart from the support 20 maintains a predetermined distance from the support 20 when the assembly 122 is taut but not a predetermined orientation relative to the support. In other words, the loop 126, which forms the pivot point about which the oar 28 pivots can translate radially about the support 20. With further reference to FIG. 6, this advantageously allows the user to position the paddle portion of each oar 28 in a closely-spaced arrangement along a length of the SUP 10. This provides for efficient translation of the paddle portion of each oar 28 to provide for generally linear movement of the paddle portion.

Figures 5A, 5B:
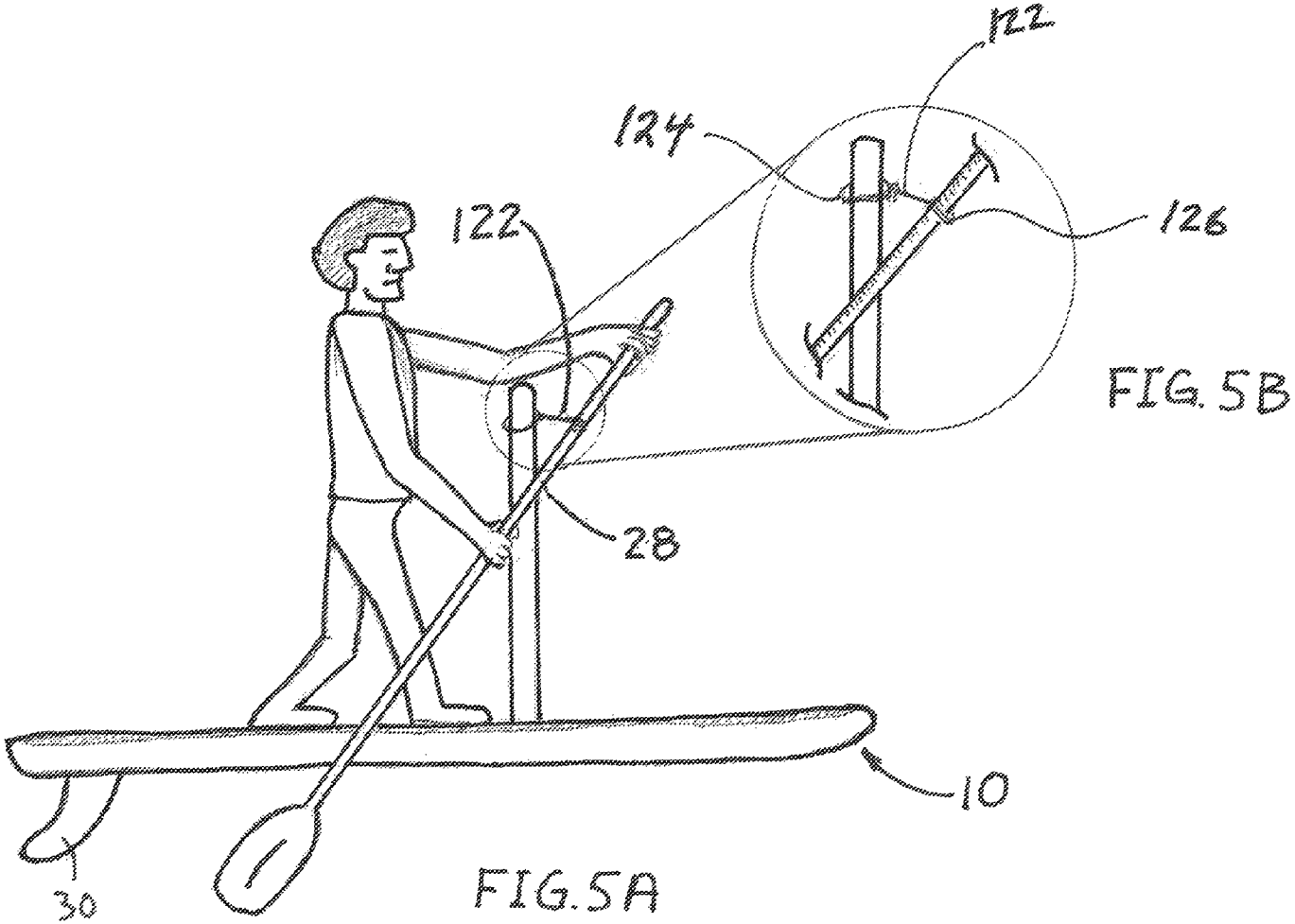
FIG. 5A is a side view of a stand up paddleboard having an oar engaged with a front-facing pivot of a support according to one or more embodiments disclosed herein, where the front-facing pivot includes a flexible member for engaging the oar.
FIG. 5B is an enlarged partial view of the flexible member of FIG. 5A.

FIG. 5A illustrates an approach to providing and supporting multi-axis degree of freedom to a paddle stroke. Other apparatuses capable of providing multi-axis degrees of freedom may be contemplated including flexible, rigid and semi-rigid components. Exemplary components may include at least one gimbal, ball and socket, u-joint, flexible conduit, rubber, rope, chain, cable, or combinations thereof. These can be integrated directly into the support post or paddle system, or attached by tying or hooking or threading through a hole to the post and paddle. Cantilevers associated with 22A and 22B may be removed as indicated in FIG. 5A for a cantilever free system.

Support 20 and associated elements may be provided as a stand-alone product configured for retrofitting to a SUP, or may be provided as a kit that includes a support 20 and SUP 10. Support 20 may further define one or more user interfaces or display screens that are communicatively coupled to a computer that provides functionality such as GPS, time, and computer-implemented programs. Other features such as a beverage holder, cellular phone or mobile device holder, and the like may be provided.

Figures 6A, 6B:
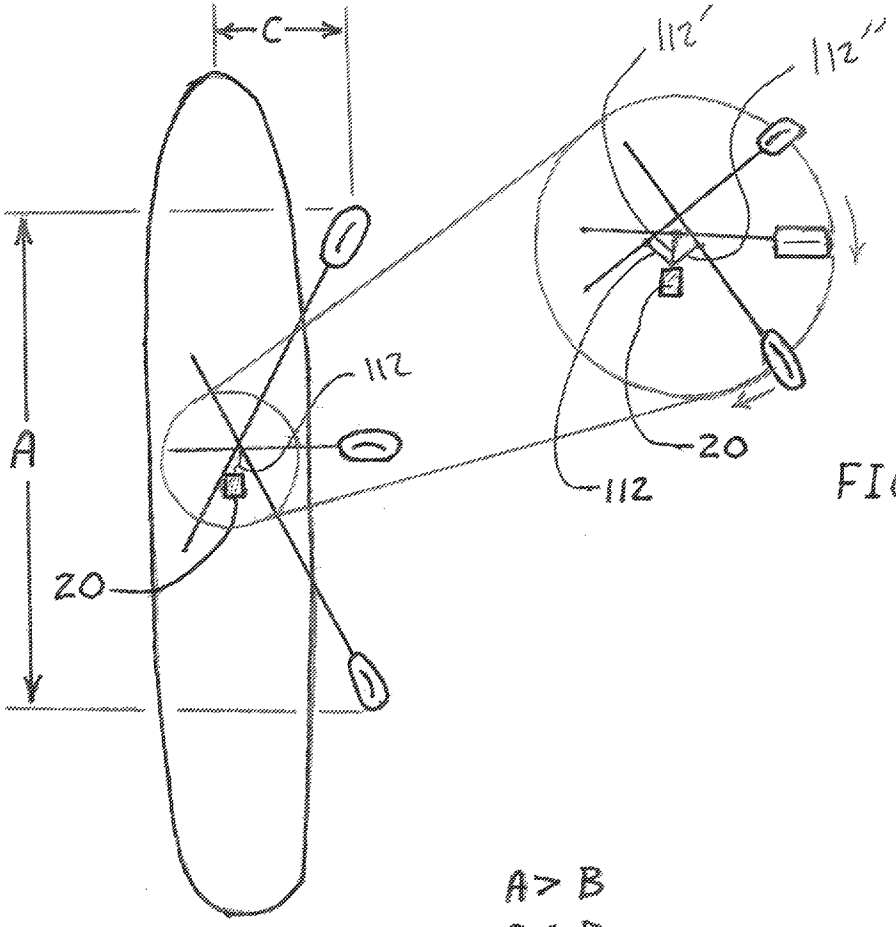
FIG. 6A is a top, sequential view of an oar being pivoted about the support for the embodiment including a flexible member.
FIG. 6B is an enlarged view of a portion of FIG. 6A.
Figure 7:
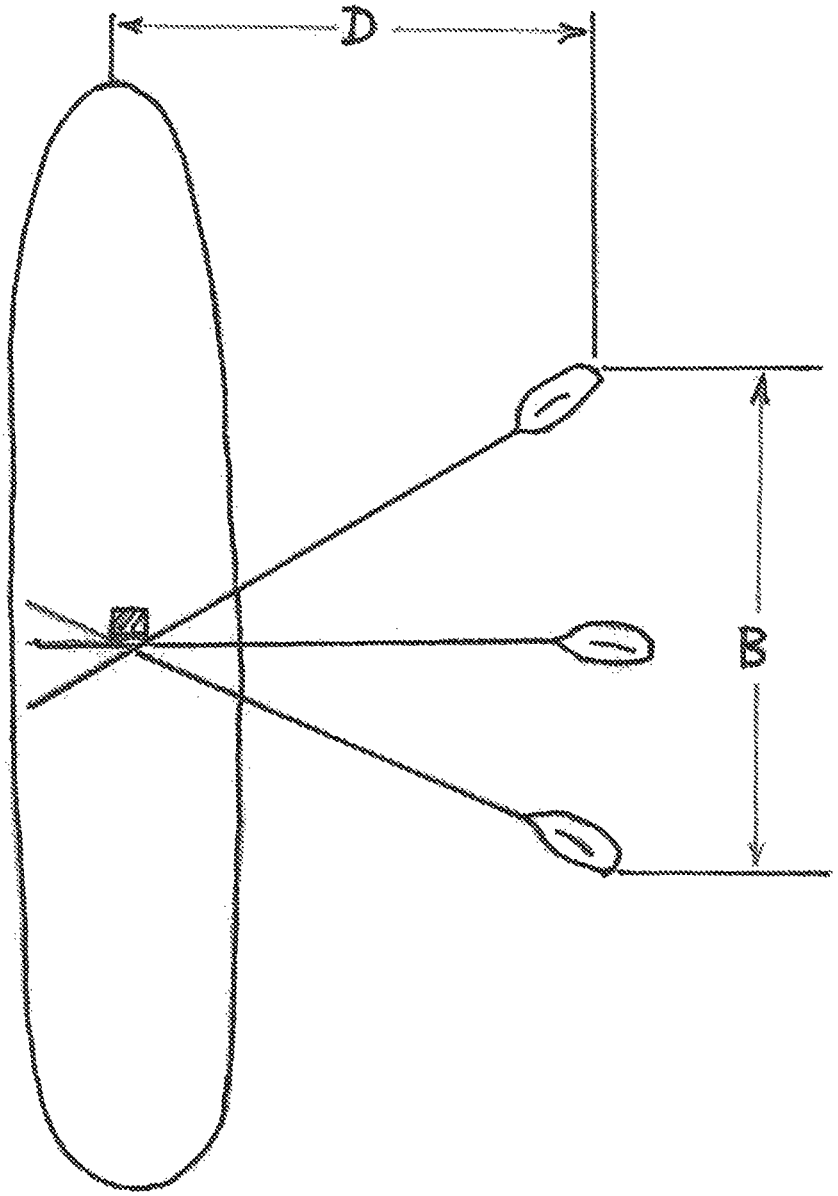
FIG. 7 is a top, sequential view of an oar being pivoted about the support in an embodiment where the pivot is rear-facing about the support.

The overhead sequential view of FIG. 6 shows the front-facing pivot arrangement of the embodiment shown in FIG. 5 is compared with the overhead sequential view of FIG. 7 that shows the rear-facing pivot arrangement of FIG. 3. Without the ability to move the engagement point of the oar with the pivot such as the configuration of FIG. 5 with the flexible member 122 allows, the paddle portion of oar 28 is further spaced-apart from the SUP 10 compared to the arrangement of FIG. 5 (distance D in FIG. 7 compared with distance C in FIG. 6A). This further spacing of the paddle portion of oar 28 provides for a shorter stroke distance (distance B in FIG. 7 compared to distance A in FIG. 6).

As illustrated in FIG. 6A, flexible member 112 is shown where the paddle portion of oar 28 is in a most fore position, flexible member 112' is shown where the paddle portion of oar 28 is in a generally medial position, flexible member 112" is shown where the paddle portion of oar 28 is in a generally aft position. As such, movement of flexible member is shown sequentially by 112, 112', and 112" in FIG. 6B.

In one or more embodiments, the support is removable and engaged by attaching to a permanent mount on the top surface of the board. In one or more embodiments, the support is integrated into the board and is folding and selectively engagable.

In general, a board suitable for use in water sports includes a body with an upper surface and a lower surface displacing much less or negligible water as compared to a typical boating hull of substantial volume. The lightweight board is constructed of wood, fiberglass, foam, polyester, polyurethane, polystyrene, epoxy resin, compressed air membrane, composites hybrids, and combinations thereof with a vertical support allowing for forward propulsion. This invention incorporates a stand up paddleboard comprising a user positioned facing the direction of motion. The user strokes a paddle pivoting from an upright support thus propelling the board forward. Leverage for the paddle stroke is defined by the user's body, hand positions on the paddle shaft, orientation of the blade and upright support. Preferred location of the pivot point may be between the user's waist and shoulders. The paddle board may have a base portion having an upper facing surface configured for being stood upon by a user and a downward facing generally flat planar surface. It also may have characteristics such as a shallow displacement and waterline. The support 20 is selectively engageable with the base portion 12 and defining one or more pivot points for pivoting a SUP paddle about the pivot point during the propulsion stroke. The stroke in some instances may be defined as a linear motion or a slight arc motion, close to the water line of the planer surface. For transportation, the upright support 20 may be de-engaged by folding it down or removing the support 20. Hence the paddleboard 10 has a first configuration in which the support 20 is not engaged with the base portion 12 and second configuration in which the support 10 is engaged with the base portion 12 and extends in a generally upwardly direction from the upper facing surface of the base portion. Ordinarily the user will engage the pivot points and upright support 20 with a paddle shaft while standing on the board 10 facing forward in the direction of travel. When the support 20 is disengaged from the planar surface, the board may be used to surf waves similar to a surf board. Although it is preferred to have a single post for a single user, duel or multiple posts may be desired for tandem user operation. In this configuration, each user may incorporate a single shaft and blade paddle, and in some cases a single shaft with a blade on each end.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A stand up paddleboard, comprising a rigid support increasing stability and leverage to form a fulcrum:

a base portion having an upper facing surface configured for being stood upon by a user and a downward facing generally flat planar surface; and a support selectively engageable with the base portion and defining one or more pivot points for pivoting an oar about the pivot point during rowing;

the pivot point distal from the base and forward facing maintaining a tether as a free and flexible assembly at a predetermined distance from the rigid support;

wherein the paddleboard has a first configuration in which the support is not engaged with the base portion and second configuration in which the support is engaged with the base portion and extends rigidly in a generally upwardly direction from the upper facing surface of the base portion.

2. The paddleboard of claim 1, wherein the support is a single support.

3. The paddleboard of claim 1, wherein the support is adjustable in length to thereby adjust the height of the one or more pivot points.

4. The paddleboard of claim 3, wherein the one or more pivot points includes a pivot point that is forward-facing of the support when the support is engaged with the base portion.

5. The paddleboard of claim 4, wherein the pivot point that is forward-facing of the support comprises a flexible assembly extending from the support and selectively engaging with the oar at and end spaced-apart from the support.

6. The paddleboard of claim 5, wherein the flexible assembly is configured such that the end spaced-apart from the support maintains a predetermined distance from the support base but not a predetermined orientation relative to the support.

7. The paddleboard of claim 1, wherein the support defines a portion for stability being grasped by a user seated and standing on the paddleboard.

8. The paddleboard of claim 1, further including a skeg extending from the bottom facing surface.

9. The paddleboard of claim 1, wherein the support is selectively engageable about a support base.

10. The paddleboard of claim 1, wherein the support is removable and engaged by attaching to a permanent integrated mount on the top surface of the board.

11. The paddleboard of claim 1, wherein the support is integrated into the board and is folding and selectably engagable.

* * * * *